US006742684B2

(12) United States Patent
Oh

(10) Patent No.: US 6,742,684 B2
(45) Date of Patent: Jun. 1, 2004

(54) WHEELED BACKPACK

(75) Inventor: Scott Oh, Carson, CA (US)

(73) Assignee: Luggage America, Inc., Carson, CA (US)

( * ) Notice: Subject to any disclaimer, the term of this patent is extended or adjusted under 35 U.S.C. 154(b) by 0 days.

(21) Appl. No.: 10/145,272

(22) Filed: May 14, 2002

(65) Prior Publication Data

US 2003/0213821 A1 Nov. 20, 2003

(51) Int. Cl.[7] ..... A45F 4/02
(52) U.S. Cl. ..... 224/153; 224/643; 224/652
(58) Field of Search ..... 224/153, 643, 224/652

(56) References Cited

U.S. PATENT DOCUMENTS

D375,402 S * 11/1996 Yeh ..... D3/217
D387,198 S 12/1997 Lehmann et al.
5,749,503 A * 5/1998 Wulf et al. ..... 224/153
5,893,495 A 4/1999 Godshaw et al.
5,984,154 A * 11/1999 Scicluna ..... 224/153
6,095,385 A 8/2000 Utu et al.
6,129,254 A * 10/2000 Yu ..... 224/575
6,279,706 B1 8/2001 Mao
D448,161 S * 9/2001 Holodnicki ..... D3/217
6,305,587 B1 10/2001 Miller

* cited by examiner

*Primary Examiner*—Stephen K. Cronin
(74) *Attorney, Agent, or Firm*—Lee, Hong, Degerman, Kang & Schmadeka

(57) ABSTRACT

An improved convertible luggage which conveniently converts from a wheeled suitcase to a backpack having a first compartment, a pair of wheels mounted to the first compartment, a second compartment affixed to the first compartment, a second compartment, a first cover on the backside of the first compartment forming a pocket, a frame piece situated within that pocket, a second cover, and a pair of shoulder straps. The frame piece is attached to an extendable handle, which gives the convertible luggage greater stability and rigidity while not detracting from the backpack's overall aesthetics nor lessening user comfort. The shoulder straps have two ends wherein the ends are affixed within the second compartment, such that the straps can be deployed by opening the second compartment, and when the second compartment is closed, the straps are secured within the second compartment.

11 Claims, 5 Drawing Sheets

WHEELED BACKPACK

BACKGROUND OF THE INVENTION

1. Field of the Invention

The present invention relates to generally to luggage containers. More specifically, to convertible luggage that can be used as a wheeled suitcase and backpack.

2. Discussion of the Related Art

A challenge to traveling has always been carrying one's belongings in the most efficient and easy manner. To meet this challenge, convertible luggage designs have appeared in the prior art to convert from a wheeled suitcase to a backpack, and vice versa. However, prior art designs have had various problems concerning manufacturing, manufacturing cost, user comfort and aesthetics. In particular, wheeled backpacks require a rigid frame piece located on the backside of the backpack to support the extendable handle, indirectly supporting the weight of the backpack and the contents therein when used as wheeled luggage.

As shown in FIG. 1, the prior art shows a wheeled backpack 7 with a rigid frame piece 17 supporting the extendable handle 27 on the backpack. The rigid frame piece 17 is secured to the top side of the backpack 7 with rivets 37*a* and 37*b* as well as other means of fastening such as chemical adhesives or fabric stitching. The rigid frame piece 17 is often constructed of hard plastic, light weight metal, or other non-pliable material. Generally, the sleeves 47 of the extending members 57 of the extendable handle are fused to the rigid frame piece 17, constituting one single component.

The presence of this single component creates several disadvantages to the prior art design. Firstly, material cost for rivets 37*a* and 37*b* and adhesive for securing the rigid frame piece 17 to the backpack 7, material cost for the rigid frame piece 17, and manufacturing and labor costs in incorporating these parts are added to the overall cost of producing the wheeled backpack 7. Secondly, when in backpack configuration, user comfort is decreased because the rigid frame piece 17 can further protrude the extendable handle into the user's shoulders, back, head and neck areas. Thirdly, the rigid frame piece 17 limits the expandable features of the wheeled backpack. Finally, the presence of the rigid frame piece 17 and rivets 37 detract from the overall aesthetics of the wheeled backpack 7. Although various attempts have been made to solve these problems, as popularity of convertible suitcases become increasingly more popular, an improved design is needed.

SUMMARY OF THE INVENTION

Accordingly, the present invention is directed to an improved luggage apparatus that substantially obviates one or more of the problems due to limitations and disadvantages of the related art.

An object of the present invention is to provide a wheeled backpack that is aesthetically pleasing, that increases user comfort, and that decreases manufacturing, material and labor costs and while retaining sufficient rigidity and stability.

To achieve these and other advantages and in accordance with the purpose of the present invention, as embodied and broadly described, a convertible luggage container capable of being in a backpack mode or a wheeled suitcase mode comprises a first compartment having a backside with a top edge; a pair of wheels mounted to the first compartment; a second compartment affixed to the first compartment; a first cover having a bottom edge and is affixed to the backside of the first compartment near the top edge, wherein a pocket is formed; a frame piece that is attached to an extendable handle and that is affixed to the first compartment, wherein the frame piece is situated within the pocket; a second cover defining and providing access to the second compartment; and a pair of shoulder straps having two ends wherein the ends are affixed within the second compartment, such that the straps can be deployed by opening the second compartment, and when the second compartment is closed, the straps are secured within the second compartment.

According to one aspect of the present invention, an additional cover is formed near the top edge of the backside of the first compartment so that a pocket is formed in which the frame piece would be situated in, thus securing the frame piece to the backside of the first compartment.

According to another aspect of the present invention, the cover is defined by a front side, a back side, a top edge, a bottom edge, a first and second side edges and a center, wherein the cover further comprises a first and second fasteners attached near the first and second side edges of the back side. The cover further comprises a third fastener attached near the center of the front side. In preferred embodiments, the first and second fasteners are exposed by opening the cover and wrapping it over the bottom edge covering the pair of wheels and removably affixed to the first compartment using the third fastener when in the convertible luggage is in the backpack mode. Still further, the wheels are cushioned by the thickness of the cover since it is wrapped over the wheels.

Advantages of the present invention over the prior art include the lack of an exposed rigid frame piece, which can cause discomfort to the user during movement when the luggage item is used as a backpack. In addition, manufacturing and material costs are lessened by providing a smaller frame piece enclosed within the main compartment. Other advantages include the ability to eliminate unnecessary strap buckles along the outside of the luggage. By completely enclosing the shoulder straps within the second compartment, the luggage can be better used in tight spaces and other situations where the buckles may get entangled or exposed to damage (e.g. baggage claim at an airport.) In addition, by providing a layer of cushion between the user and the wheels of the luggage, additional comfort can be given to the wearer of the luggage in the backpack mode.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Hereinafter, the present invention will be described with respect to the preferred embodiment illustrated in the annexed drawings.

Figure 1:
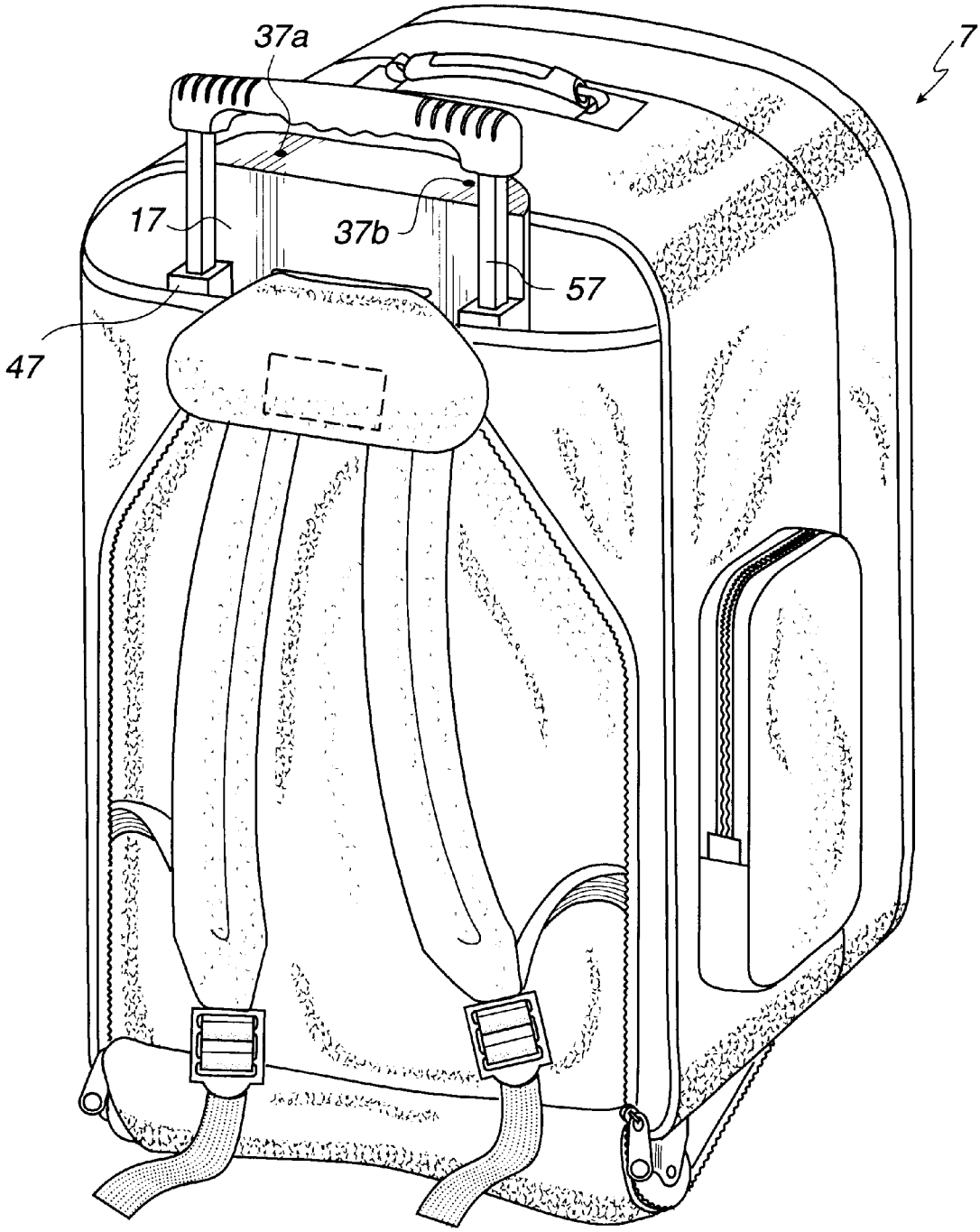
Fig. 1 (Prior Art)
FIG. 1 is a rear perspective view of the convertible luggage in the backpack configuration according to prior art.
Figure 2:
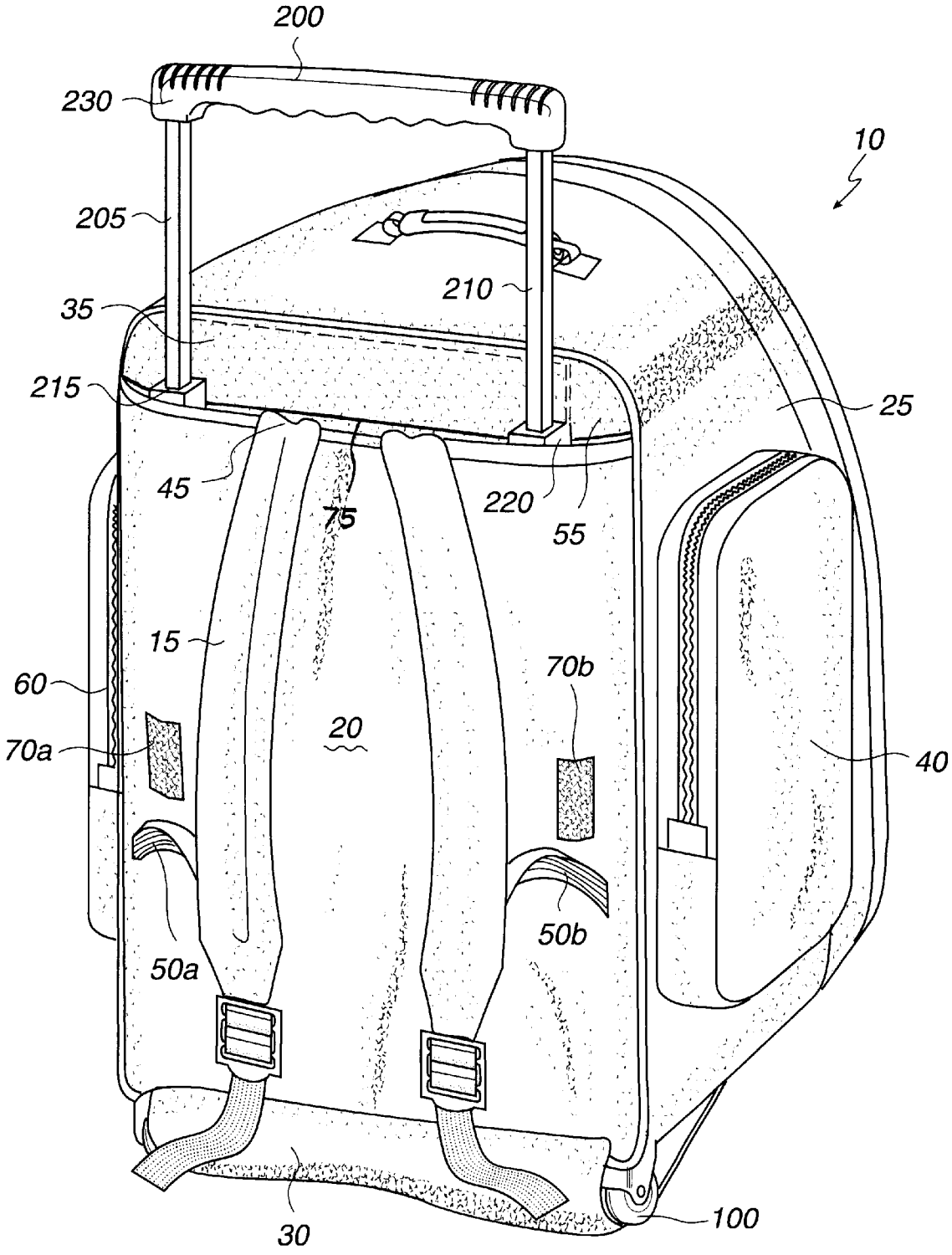
FIG. 2 is a rear perspective view of the convertible luggage in the backpack configuration in accordance with the preferred embodiments of the present invention.

FIG. 2 is a perspective view of the convertible luggage in the backpack configuration in accordance with the preferred embodiments of the present invention. As shown in FIG. 2, the backpack 10 is fully converted from wheeled suitcase, with a pair of straps 15 which can be worn over the user's shoulders such that the back side of the luggage is carried snug across the user's back. The backpack 10 can be formed of any convenient durable material, such as canvas, fabric, nylon, leather, plastic (e.g. vinyl), etc. The backpack 10 has two compartments 20, 25 wherein the main compartment 25 is used to keep the user's belongings, while a second compartment 20 is used to maintain a pair of shoulder straps 15 while in the backpack 10 is in the wheeled suitcase mode. In addition, in preferred embodiments, side compartments 40 and 60 are also attached to the main compartment 25, which can used to store additional items for the user.

As seen in FIG. 2, the second compartment 20 is affixed to the backside of the main compartment 25. Suitable fasteners known to one of ordinary skill in the art, such as hook and loop fasteners (as shown as 70*a* and 70*b*) or the like are used to secure the second compartment cover 30. When the second compartment 20 is fully opened, the second compartment cover 30 is permanently attached to the bottom edge 35 of the luggage 10, and can be folded over the wheels 100, as will be discussed in greater detail with respect to FIG. 5.

Also shown in FIG. 2, a pair of shoulder straps 15 is positioned in the second compartment 20. The shoulder straps 15 are standard cushioned shoulder pads used with permanently attached to the bottom edge 35 of the luggage 10, and can be folded over the wheels 100, as will be discussed in greater detail with respect to FIG. 5.

Also shown in FIG. 2, a pair of shoulder straps 15 is positioned in the second compartment 20. The shoulder straps 15 are standard cushioned shoulder pads used with existing backpacks and well known in the art. Before the second compartment cover 30 is opened, the straps 15 are concealed by the cover 30. When the second compartment cover 30 is opened, the straps 15 are exposed and deployed from the second compartment 20. The ends of the shoulder straps are affixed to the second compartment at a position close to the top edge 45. In addition, the second ends of the straps 15 sown directly within the second compartment 20 at points 50*a* and 50*b*. Therefore, the straps are fully encased within the second compartment 20 when the second compartment cover 30 is fastened to the backside of the main compartment 25 (best seen in FIG. 3). Thus, there is no need to attach straps 15 to outside buckles as in other prior art designs, where outside buckles can be both aesthetically unpleasing and also interfere with the use of the luggage as a wheeled suitcase (e.g. can get caught in doorways or tight spaces, etc.). Moreover, by keeping straps 15 completely within the second compartment 20, side compartments 40 and 60 can be attached to the main compartment 25 without interference from any buckles or other fastening means on the outside of the main compartment 25.

Further in FIG. 2, as in other prior art convertible luggage designs, the backpack 10 has an extendable handle 200 and wheels 100 which are attached to the mainframe of the backpack 10. The extendable handle 200 constitutes two extending member 205 and 210, which travel in the vertical direction through corresponding sleeves 215 and 220 and a gripping member 230. The sleeves are secured to a frame piece 35, which is hidden from direct view (but shown in outline form) because it resides within a pocket 75, which is created by a cover 55 attached to the backside of the main compartment 25. The frame piece 35 is shown outside of the pocket 75 in FIG. 3. In preferred embodiments, the frame piece 35 and sleeves 215 and 220 are of uniform construction and made of plastic. A single plastic piece consisting of the frame piece 35 and sleeves 215 and 220 can be molded. Consequently, the use of the frame piece 35 provides for less material and labor to be required in order to provide a backpack with relatively the same structural rigidity and stability as one of the prior art.

Figure 3:
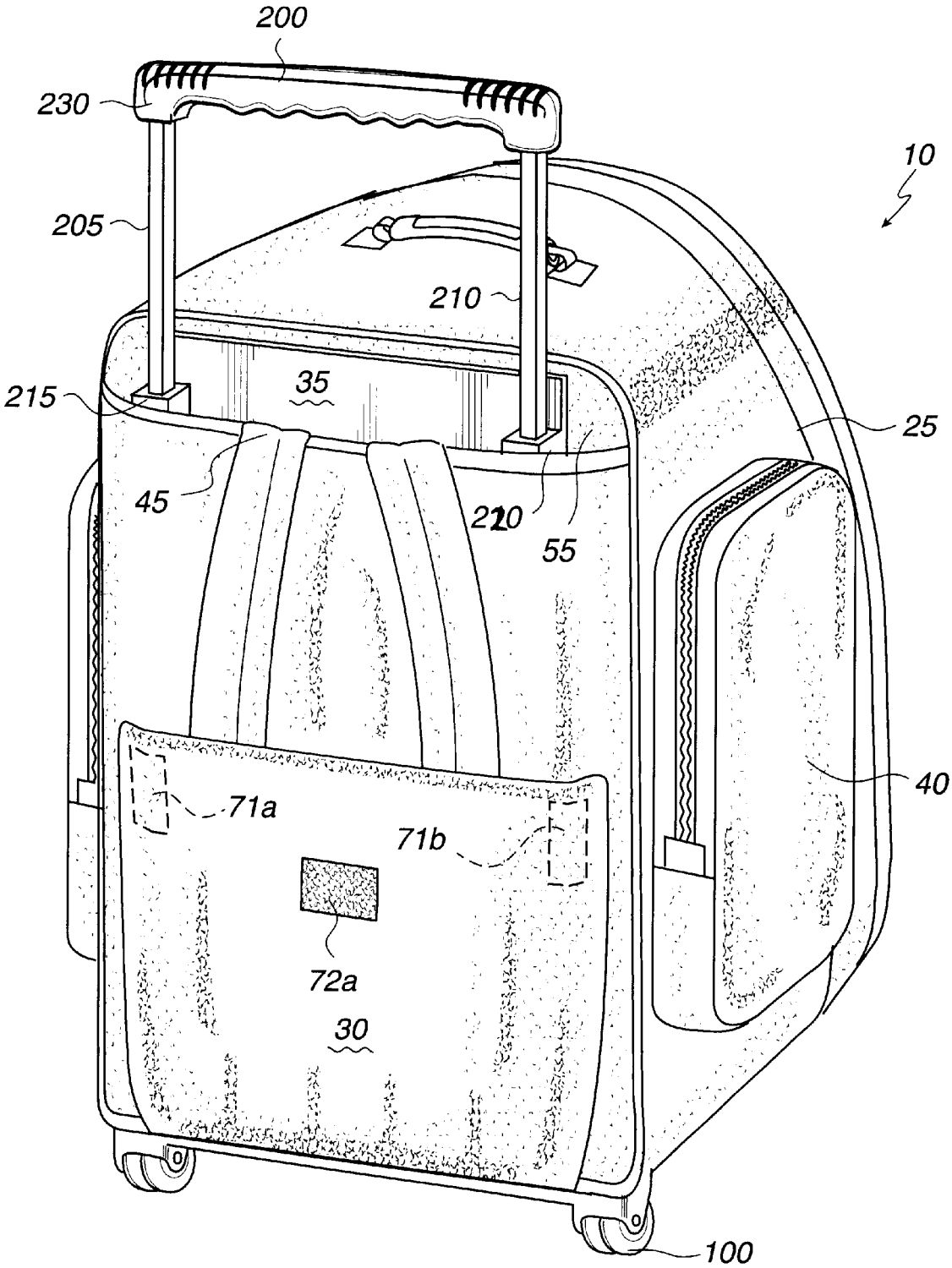
FIG. 3 is a rear perspective view of the convertible luggage in the wheeled suitcase configuration in accordance with the preferred embodiments of the present invention.

FIG. 3 is a perspective view of the backpack 10 in the wheeled suitcase configuration in accordance with the preferred embodiments of the present invention. The frame piece 35 is shown situated outside of the pocket 75 formed by the cover 55. Also, the second compartment 20 is closed, hiding and protecting the straps 15 during the times when the backpack 10 is wheeled. The extendable handle 200 is mounted on the first compartment 25 at a position that is adjacent to the backside of the first compartment 25. In the wheeled suitcase configuration, the handle 200 extends out of the top of the first compartment 25 to a predetermined distance and used by the user to pull the backpack 10 by rolling the wheels 100 after tilting the backpack 10. Hidden from direct view, but shown in outline form in FIG. 3 are the corresponding receptors to fasteners 70*a* and 70*b* (71*a* and 71*b*). Fasteners 70*a* and 70*b* and their corresponding receptors 71*a* and 71*b* are used to secure the second compartment cover 30 and close the second compartment 20. Fastener 72*a*, also a suitable fasteners known to one of ordinary skill in the art, such as a hook and loop fastener, will be discussed in greater detail with FIG. 5.

Figure 4A:
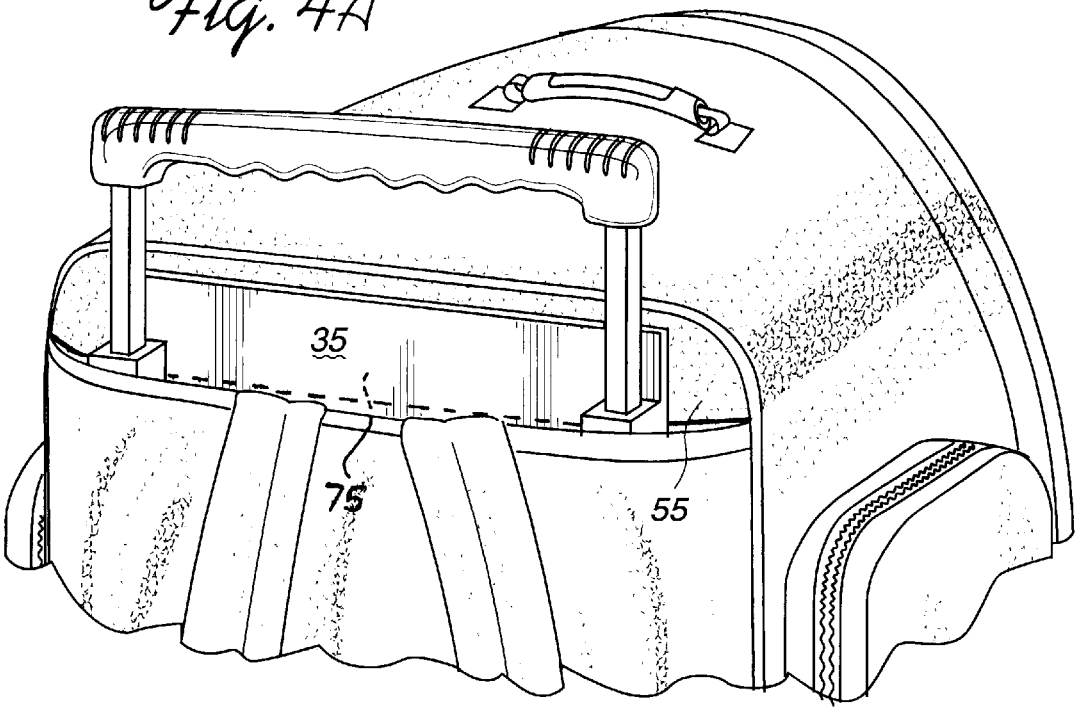
FIGS. 4A and 4B are close-up rear perspective views of the frame piece of the convertible luggage in accordance with the preferred embodiments of the present invention.
Figure 4B:
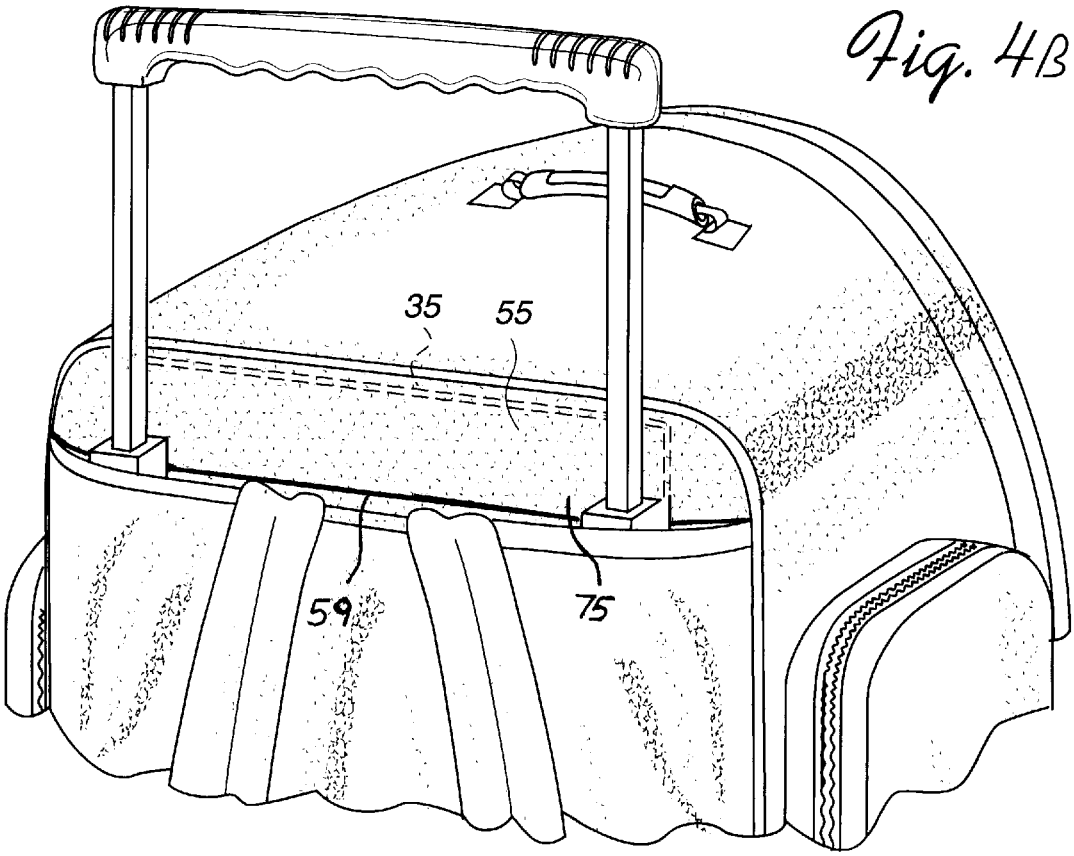

FIG. 4A illustrates the frame piece 35 situated outside of the pocket 75 formed by the 135 cover 55. The pocket 75 is formed by integrating a cover 55 to the backside of the main compartment 25 such that the frame piece 35 is inserted into the pocket 75. In FIG. 4B, the bottom edge 59 of the cover 55 is shown, and thereby securing the frame piece 35 within the pocket 75. Alternatively, the frame piece 35 is secured to the backside of the main compartment 25 by means known to one of ordinary skill in the art, such as chemical adhesive. The addition of the frame piece 35 provides adequate stability and rigidity to the backpack 10 without detracting from its overall aesthetics or lessening user comfort.

Figure 5A:
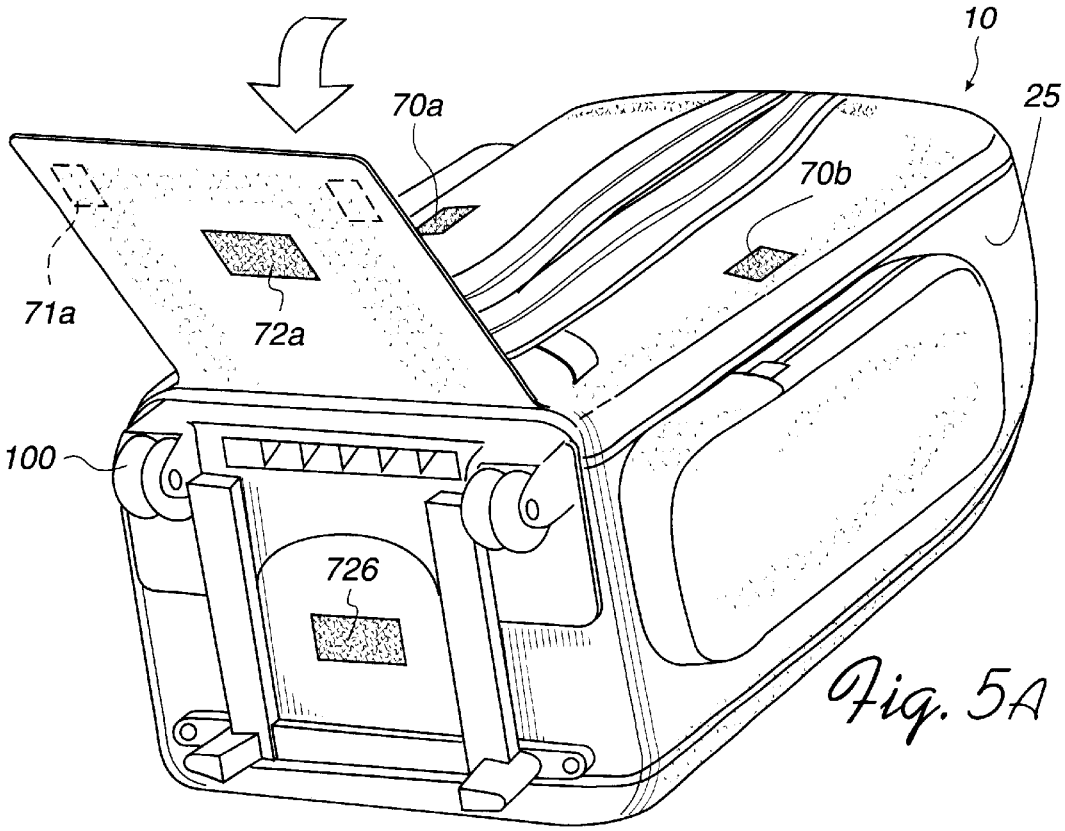
FIGS. 5A and 5B are bottom perspective views illustrating the view illustrating the conversion of the wheeled suitcase into the backpack configuration in accordance with the preferred embodiments of the present invention.
Figure 5B:
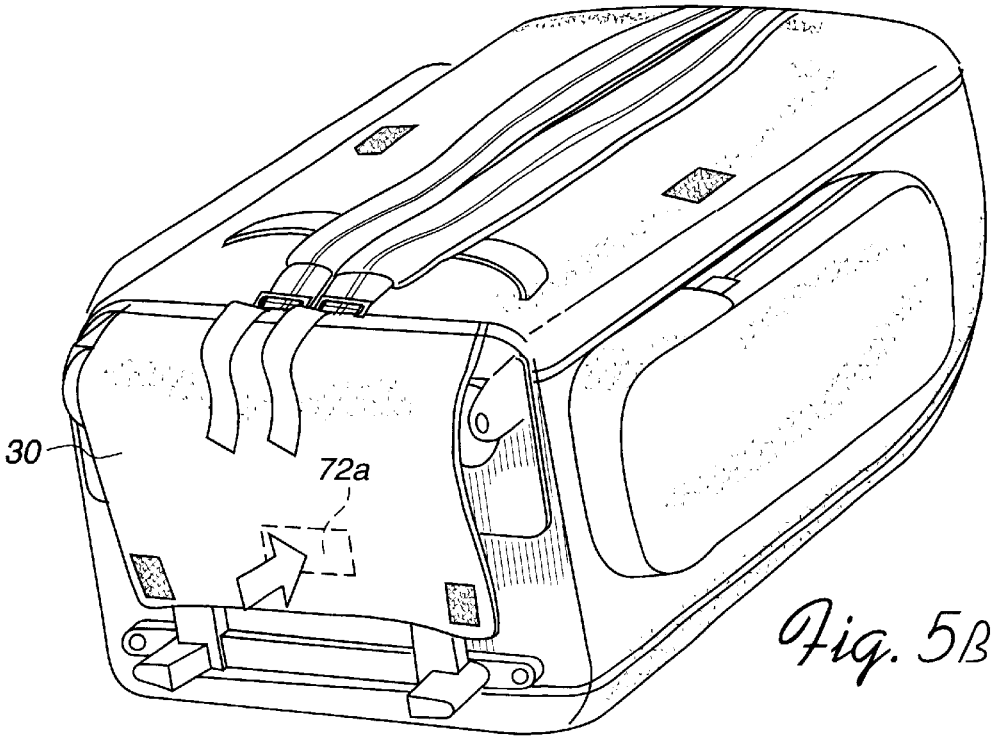

FIGS. 5A and 5B are views illustrating the conversion of the wheeled suitcase into the backpack configuration in accordance with the preferred embodiments of the present invention. As seen in FIG. 5A, the second compartment cover 30 can be opened by unfastening the fasteners 71*a* and 71*b* from their corresponding receptors 70*a* and 70*b* on the backside of the main compartment 25. The cover 30 is then folded over the wheels 100 as seen in FIG. 5A and 5B. Thus, the outer side of the cover 30 is wrapped around the portion of the wheels, which face the back side of the luggage, and fastener 72*a* is secured to its corresponding fastening receptor 72*b*, located on the bottom of the luggage 10. In this manner, the wheels 100 are covered to eliminate any discomfort for the user while the user wears the luggage 10 in the backpack mode. Given that in preferred embodiments where the luggage 10 is used as a backpack, additional comfort for the user is provided against the wheels 120 since the cover 30 is padded, thus providing additional comfort for the user of the luggage 10. In addition, by covering the wheels 100, the user's back, clothing and belongings are protected from debris accumulated on the wheels 100 while the wheels 100 are rolled along an unclean surface. According to the preferred embodiment of the present invention, the wheels 100 are dual wheels (two wheels on each side) to provide stability and easy transport.

Those skilled in the art will appreciate that alternative embodiments exists from the description of the preferred embodiments without departing from the spirit and scope of the invention. Preferred embodiments were shown in the context of a standard carry-on size luggage. However, in alternative embodiments, a full size luggage or a luggage with additional compartments can be substituted for the preferred luggage. For example, a third compartment can be affixed to the front side of the first compartment, where the third compartment is optionally removable as a day pack. In addition, although the convertible luggage was described as being convertible from a wheeled suitcase to a backpack, the convertible luggage can always be carried by hand using handles attached to the luggage or carrying the luggage by the shoulder straps rather than wearing the luggage on the user's back.

In the described embodiments, the fasteners were described as hook and loop fasteners. In alternative embodiments, any fastener can be used including buttons, additional zippers, snaps or the like. In addition, the shoulder straps can take any known mechanism allowing the user to hold the luggage on the user's back. For example, the shoulder straps can comprise a single strap to place over one shoulder and body of the user while the user wears the luggage in the backpack mode. Moreover, although the preferred embodiments were described as having a cushioned straps and cushioned cover, the entire second compartment can be made from a cushioned material known in the art (e.g. styrofoam) to better cushion the back of the user while wearing luggage as a backpack.

Therefore, the foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the composition of the invention. Since many embodiments of the invention can be made without departing from the spirit and scope of the invention, the invention resides in the claims hereinafter appended.

What is claimed is:

1. A convertible luggage container capable of being in a backpack mode or a wheeled suitcase mode comprising:

a first compartment having a backside with a top edge;

a pair of wheels mounted to the first compartment;

a second compartment affixed to the first compartment;

a first cover having a bottom edge and is affixed to the backside of the first compartment near the top edge, wherein a pocket is formed;

an extendable handle comprising a gripping member secured to a first and second extending members that travel in the vertical direction through first and second sleeves;

a frame piece disposed in the pocket, wherein the frame piece and first and second sleeves are of uniform construction and the frame piece is firmly held within the pocket without engaging the first compartment;

a second cover defining and providing access to the second compartment; and a pair of shoulder straps having two ends wherein the ends are affixed within the second compartment, such that the straps can be deployed by opening the second compartment, and when the second compartment is closed, the straps are secured within the second compartment.

2. The convertible luggage of claim 1, wherein the bottom edge of the first cover is secured to the backside of the first compartment with a chemical adhesive.

3. The convertible luggage of claim 1, wherein the bottom edge of the first cover is secured to the backside of the first compartment with stitching.

4. The convertible luggage of claim 1, wherein the frame piece and first and second sleeves comprise a plastic.

5. The convertible luggage of claim 1, further comprising: a third compartment affixed to the first compartment perpendicular to the second compartment.

6. The convertible luggage of claim 1, wherein the frame piece comprises a flat cross bar.

7. The convertible luggage of claim 1, wherein the frame piece and first and second sleeves are of monolithic construction.

8. The convertible luggage of claim 1, wherein the cover is defined by a front side, a back side, a top edge, a bottom edge, a first and second side edges and a center, wherein the cover further comprises a first and second fasteners attached near the first and second side edges, respectively, on the front side of the cover.

9. The convertible luggage of claim 8, wherein the cover further comprises a third fastener attached near the center of the back side of the cover.

10. The convertible luggage of claim 9, wherein the cover is removably affixed to the first compartment when the cover is wrapped over the bottom edge covering the pair of wheels in the backpack mode.

11. The convertible luggage of claim 10, wherein the wheels are cushioned by the thickness of the cover since the cover is wrapped over the bottom edge and removably affixed to the first compartment using the third fastener.

* * * * *